US005292113A

United States Patent [19]

Morigami et al.

[11] Patent Number: 5,292,113

[45] Date of Patent: Mar. 8, 1994

[54] AUTOMATIC DOCUMENT FEEDER

[75] Inventors: Yuusuke Morigami; Hirokazu Matsuo; Hirofumi Tanahashi, all of Toyohashi; Yoshihito Hirano, Toyokawa; Hiroyasu Nagato, Toyokawa; Takuma Ishikawa, Toyokawa, all of Japan

[73] Assignee: Minolta Camera Kabushiki Kaisha, Osaka, Japan

[21] Appl. No.: 951,841

[22] Filed: Sep. 28, 1992

[30] Foreign Application Priority Data

| | | | |
|---|---|---|---|
| Sep. 30, 1991 | [JP] | Japan | 3-252421 |
| Sep. 30, 1991 | [JP] | Japan | 3-252422 |
| Sep. 30, 1991 | [JP] | Japan | 3-252423 |
| Sep. 30, 1991 | [JP] | Japan | 3-252424 |
| Sep. 30, 1991 | [JP] | Japan | 3-252425 |

[51] Int. Cl.[5] ..... B65H 5/22

[52] U.S. Cl. ..... 271/7; 271/198; 271/275

[58] Field of Search ..... 271/3, 7, 275, 198

[56] References Cited

U.S. PATENT DOCUMENTS

| | | | |
|---|---|---|---|
| 4,185,908 | 1/1980 | Taylor et al. | 271/275 |
| 4,285,512 | 8/1981 | Shlatz | 271/233 |
| 4,353,541 | 10/1982 | Parzygnat | 271/275 |
| 4,844,445 | 7/1989 | Murata et al. | 271/275 |
| 5,004,223 | 4/1991 | Okui | 271/275 |
| 5,213,322 | 5/1993 | Matsuo et al. | 271/275 |

FOREIGN PATENT DOCUMENTS

| | | | |
|---|---|---|---|
| 226433 | 10/1986 | Japan | 271/275 |
| 62-25484 | 6/1987 | Japan . | |

OTHER PUBLICATIONS

Tracy, Michael J, "Document Handling Belt Tensioning System", *Xerox Disclosure Journal*, vol. 4, No. 6, pp. 755–756, Nov./Dec. 1979.

*Primary Examiner*—H. Grant Skaggs

*Attorney, Agent, or Firm*—Burns, Doane, Swecker & Mathis

[57] ABSTRACT

An automatic document feeder for conveying a document on a platen glass. Back-up rollers for pressing a conveyer belt against the platen glass are loosely supported by a body frame. The shafts of a driving roller and a driven roller for rotating the conveyer belt, and the supporting member of the back-up rollers each have an end which is detachable from the body frame. The body frame has a first frame pivoted on a copying machine and a second frame for holding the conveyer belt and its motor. The second frame is connected with the first frame such that the second frame is movable from and to the platen glass with a specified range, and further the second frame is urged in a direction separating from the platen glass. The second frame is also movable in a direction perpendicular to a direction in which the pivot of the first frame extends.

12 Claims, 15 Drawing Sheets

AUTOMATIC DOCUMENT FEEDER

BACKGROUND OF THE INVENTION

1. Field of the Invention

The present invention relates to an automatic document feeder for automatically feeding and discharging a document onto and from a platen glass of an analog or a digital copying machine or image reading device.

2. Description of Related Art

In the art of electrophotographic copying machine, recently, various types of automatic document feeder (hereinafter referred to as ADF) have been provided so that copying efficiency can be improved. U.S. Pat. No. 4,285,512 and Japanese Patent Publication No. 62-25484 disclose such document feeders. Such an ADF has a conveyer belt which is endlessly laid between a driving roller and a driven roller such that it faces to a platen glass, and a document is slid on the platen glass with rotation of the conveyer belt. Conventionally, some back-up rollers are disposed inside the ring of the conveyer belt so as to press the belt on the document, which secures the conveyance of the document. A single roll or alternatively some ring rollers are used as the back-up roller.

The roll type back-up rollers may apply an uneven pressure to the document if the platen glass is deformed or if the ADF is set incorrectly. This will cause a skew of the document. The ring type back-up rollers may press a small size document with only one array of rings in respect to the document conveying direction. This will cause poor conveyance and a skew of the document.

Another problem is an exchange of conveyer belts. The conveyer belt is whitish and accordingly is soiled easily. The soiled conveyer belt degrades a copy image. For this reason, the conveyer belt must be cleaned or exchanged every certain period. In exchanging the conveyer belt, conventionally, a cover of the ADF must be removed, and the conveying section, including the driving roller, the driven roller and the back-up rollers, must be detached from the body of the ADF. Thus, the exchange of conveyer belts has been troublesome.

The ADF is fitted on the body of the copying machine by hinges at the rear side of the body and pivots on the hinges so that an operator can set a document on the platen glass manually. In order for secure conveyance of the document, the conveyer belt must be in contact with the platen glass entirely with an even pressure. However, because of errors in production of the parts and in assembly of the machine, a problem occurs in setting the conveyer belt on the platen glass. For example, because the level difference between the surface on which the hinges are fixed and the surface of the platen glass varies from machine to machine or because the surface on which the hinges are fixed and the surface of the platen glass may not be exactly parallel to each other, the conveyer belt cannot be in contact with the platen glass entirely with an even pressure.

Conventionally, in order to solve the problem, when the machine is set up, spacers are provided between the surface of the machine body and the hinges so that the level of the hinges can be adjusted to the level of the surface of the platen glass. However, this adjustment must be carried out differently and properly for each machine, and this is troublesome. In order to save the adjustment, a structure which can automatically set the conveying section in a correct position where the conveyer belt is in contact with the platen glass entirely with an even pressure is contrived. More specifically, the conveying section of the ADF is held by plates extended from the movable sides of the hinges with a clearance such that the conveying section can move up and down within the clearance. However, if the structure is simply adopted, since a conveyer belt motor and other heavy parts are disposed in the rear side of the conveying section, the front side of the conveying section may be lifted up with a shock or a vibration generated at a time of opening and closing the body of the copying machine.

A further problem is that the conveyer belt puts a manually set document out of position. When the ADF is pulled up from the copying machine for manual setting of a document, the conveyer belt slacks. Then, when the ADF is pushed down toward the platen glass, the slack part of the conveyer belt first comes into contact with the document set on the platen glass. Thereafter, as the ADF is pivoting down, the slack part moves toward the pivot of the ADF (rear side of the copying machine). With the movement of the slack part, the document set on the platen glass is moved to be out of position.

SUMMARY OF THE INVENTION

An object of the present invention is to provide an automatic document feeder which can perform fair conveyance of a document.

Another object of the present invention is to provide an automatic document feeder which makes an exchange of conveyer belts easy.

Another object of the present invention is to provide an automatic document feeder wherein a conveying section is set on a platen glass with mass balance without adjusting the level of the conveying section to the level of the platen glass, and a front side of the conveying section will not be lifted up because of a shock or a vibration.

A further object of the present invention is to provide an automatic document feeder wherein a document manually set on a platen glass is not displaced with a closing action of the automatic document feeder.

In order to attain the objects above, an automatic document feeder according to the present invention has back-up rollers which are capable of slanting in a vertical plane parallel to a document conveying direction and are capable of slanting in a vertical plane perpendicular to the document conveying direction. Since the back-up rollers move three-dimensionally, the back-up rollers are adaptable to deformation of the platen glass or poor fitting of the automatic document feeder on the copying machine body, whereby the conveyer belt is set on the platen glass entirely with an even pressure. The back-up rollers are arranged in lines in a direction perpendicular to the document conveying direction. Preferably, the lines of back-up rollers are positioned such that even the smallest size document is pressed by at least two lines of back-up rollers all the time during the conveyance. Thereby, the conveyance of a document, even in a case of a small size document, becomes stable.

In another automatic document feeder according to the present invention, front ends of a driving roller and driven roller of a conveyer belt and a supporting member of back-up rollers are unfastenable from a body frame of the automatic document feeder. In exchanging conveyer belts, the automatic document feeder is turned such that the front side is lifted upward, and the front ends of the driving roller, the driven roller and the supporting member are unfastened from the body frame. In this state, the conveyer belt can be pulled out of the driving roller and the driven roller easily.

In another automatic document feeder according to the present invention, at least one of the driving roller and the driven roller is held by a sub frame which is pivoted on a main frame of the automatic document feeder, and the pivot of the sub frame is out of a line drawn between the axis of the driving roller and the axis of the driven roller. Further, a stopper is provided so as to prevent the sub frame from pivoting toward the opposite side of the line to the side of the pivot of the sub frame. In exchanging conveyer belts, the automatic document feeder is turned upward, and the sub frame pivots. Thereby, the driving roller and the driven roller come off the main frame. While the driving roller and the driven roller are set in the main frame, the elasticity of the conveyer belt or tension applied to the sub frame provides the driving roller and the driven roller with a momentum in a direction opposite to the direction in which the rollers come off. Thereby, the conveyer belt will never be disengaged from the main frame by its own weight. In this way, the driving roller and the driven roller can be unfastened from the main frame easily for an exchange of conveyer belts and can be surely set in the main frame correctly.

Further, another automatic document feeder comprises: a first frame which is pivoted on an image forming apparatus; a second frame for holding a conveyer belt and its driving roller and driven roller; a connecting member for connecting the second frame with the first frame such that the second frame is movable from and to a platen glass within a specified range; and an urging member for urging the second frame in a direction separating from the platen glass. Since the second frame holding the driving roller and the driven roller is movable from and to the platen glass, the second frame is automatically set on the platen glass correctly even if the platen glass is inclined. Thereby, the conveyer belt is set on the platen glass entirely with an even pressure. More-over, the urging member balances the weight on the second frame.

Furthermore, another automatic document feeder according to the present invention comprises: a frame which is pivoted on an image forming apparatus; document conveying means having a conveyer belt, the document conveying means being held by the frame; and a connecting member for connecting the frame with the image forming apparatus such that the frame is movable in a direction perpendicular to a direction in which the pivot of the frame extends. When the frame is closing a platen glass, the first contact point of the conveyer belt with the platen glass is provided with a force toward the pivot of the frame. With the connecting member, however, the frame can move in a direction separating the pivot of the frame, and the force provided to the conveyer belt is offset by this movement. Thus, if a document is set on the platen glass and the frame is closing the platen glass, there is no fear that the conveyer belt may draw the document out of position.

BRIEF DESCRIPTION OF THE DRAWINGS

These and other objects and features of the present invention will be apparent from the following description with reference to the accompanying drawings in which:

FIGS. 1 through 14*a*, 14*b* show an automatic document feeder (hereinafter referred to as ADF) which is a first embodiment of the present invention;

FIG. 1 is a schematic view of the ADF showing its structure;

FIG. 2 is a perspective view of the ADF pulled up from a body of a copying machine;

FIG. 4 is a view of a reverse side of a conveyer belt showing rollers which hold the conveyer belt;

FIG. 5 is a front view of a supporting section of a driving roller;

FIG. 7 is a bottom view of a supporting section of back-up rollers;

FIG. 8 is a front view of the supporting section of the back-up rollers;

FIG. 9 is a sectional view of the supporting section of the back-up rollers;

FIG. 10 is a front view of the back-up rollers showing the pressure of the back-up rollers on the conveyer belt;

FIG. 11 is a side view of the back-up rollers showing the pressure of the back-up rollers;

FIG. 12 is a front view of a snaking prevention device comprising snaking prevention boards;

FIG. 13 is a bottom view of the snaking prevention device;

FIGS. 14*a* and 14*b* show joint and disjoint of the snaking prevention boards;

DETAILED DESCRIPTION OF THE PREFERRED EMBODIMENTS

Some exemplary automatic document feeders (ADFs) according to the present invention are hereinafter described with reference to the drawings.

First Embodiment: FIGS. 1–14*a*, 14*b*

Referring to FIGS. 1 through 3*a*, 3*b*, an ADF 10 mainly consists of a feeding section 20, a conveying section 30 having a conveyer belt 31 and a reversing-/ejecting section 90.

Figure 3A:
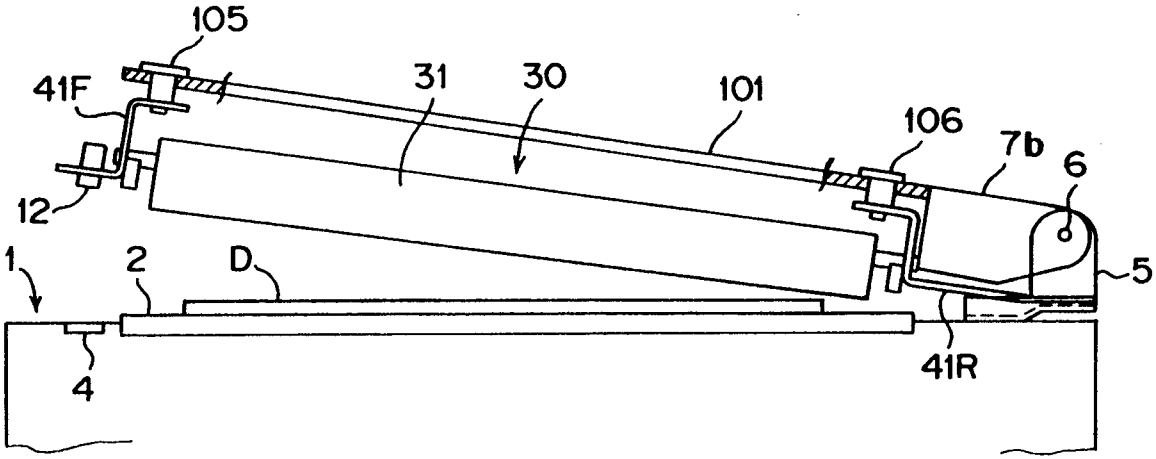
FIGS. 3*a* and 3*b* show the ADF in an open state and a closed state respectively.

The ADF 10 is fitted on an upper surface of a body 1 of a copying machine by hinges 5 at the rear side of the machine body 1, and the ADF 10 is capable of pivoting on the hinges 5. If an operator wishes to set a document D on a platen glass 2 manually, the operator should lift up the ADF 10. At that time, as shown in FIG. 3*a*, the ADF 10 pivots upward on shafts 6 of the hinges 5. Compression springs (not shown) are provided on the respective hinges 5 so as to urge the ADF 10 upward.

Thereby, the mass balance of the ADF 10 becomes stable, and the ADF 10 can be lifted up with a small force. In this structure, the ADF 10 can be stationary at any angle within the scope of keeping the mass balance of the ADF 10 by the force of the compression springs.

A handle 11 is disposed at the front side of the ADF 10, and at both sides of the handle 11, magnets 12 are disposed. Magnetic plates 4 are disposed on the upper surface of the machine body 1 so as to face to the respective magnets 12. When the ADF 10 is pushed down onto the body 1, the magnets 12 stick to the respective magnetic plates 4, whereby the ADF 10 is set on the body 1 securely. One of the magnets 12 incorporates a lead switch. The lead switch is actuated when the magnet 12 comes into contact with the magnetic plate 4. In this way, the correct and secure setting of the ADF 10 on the platen glass 2 can be detected.

Figure 1:
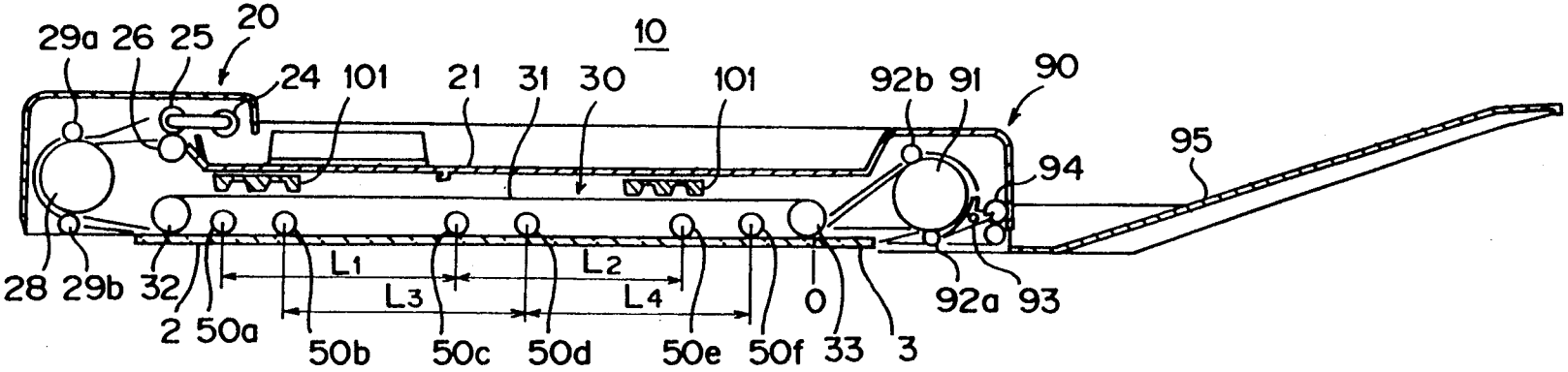
Figure 2:
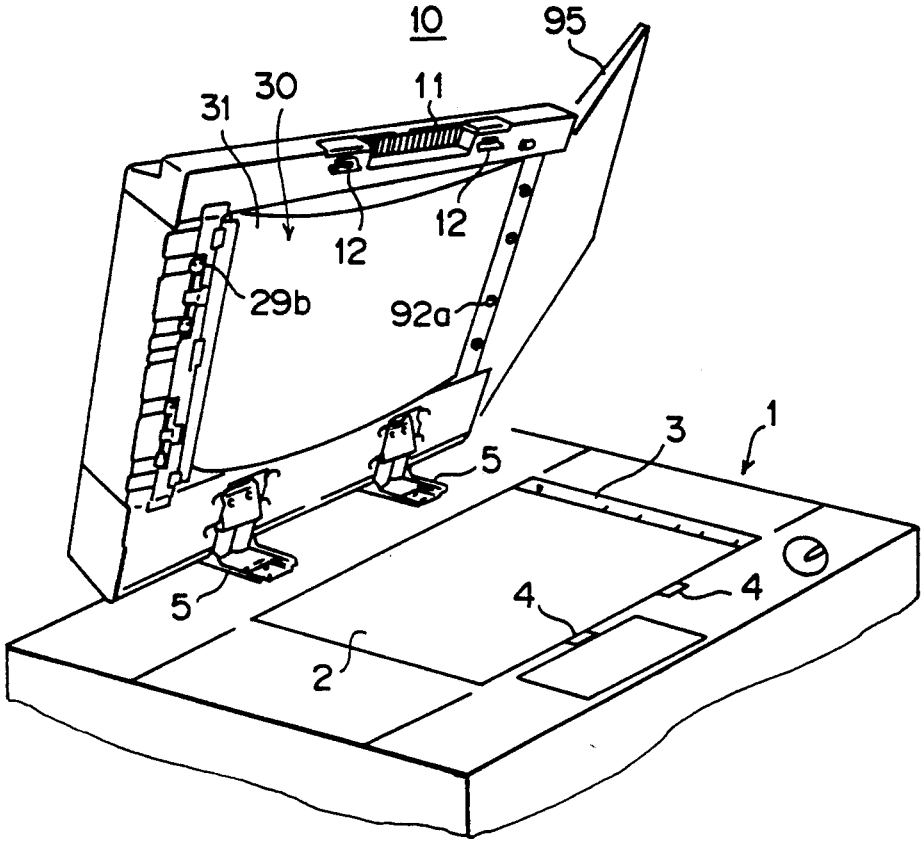

Now referring to FIG. 1, the basic structure and operation of the ADF 10 is described.

The feeding section 20 comprises a document tray 21, a pick-up roller 24, separation rollers 25 and 26, and a register roller 28 provided with pinch rollers 29*a* and 29*b*. Documents placed on the tray 21 are fed to the left with rotation of the pick-up roller 24, and a single document is separated from the others with forward rotation of the roller 25 and the reverse rotation of the roller 26. Then, the separated document is reversed along the register roller 28 and fed to an entrance of the platen glass 2.

The conveyer belt 31 is laid between a driving roller 32 and a driven roller 33 endlessly such that it covers the surface of the platen glass 2 entirely. Inside of the ring of the conveyer belt 31, back-up rollers 50*a* through 50*f* are arranged in lines. The back-up rollers 50*a* through 50*f* rotate freely and press the conveyer belt 31 against the platen glass 2. The conveyer belt 31 is driven to rotate counterclockwise and sets a document such that the leading edge of the document comes to a reference position 0 which is the border of the platen glass 2 and a scale 3.

The reversing/ejecting section 90 comprises a reversing roller 91 provided with pinch rollers 92*a* and 92*b*, a diverter 93, ejecting rollers 94 and a tray 95. In a duplex copying mode in which both sides of each document are copied, after copying of a first side of a document, the reversing roller 91 and the diverter 93 reverse the document. More specifically, the document whose first side has been copied is discharged from the platen glass 2 and guided by the diverter 93 to be transported around the reversing roller 91. Thereby, the document is reversed and returned onto the platen glass 2. In returning the reversed document onto the platen glass 2, the conveyer belt 31 is driven to rotate clockwise. After copying of a second side of the document, the document is reversed again by the diverter 93 and the reversing roller 91 and ejected onto the tray 95. Thereby, documents are ejected onto the tray 95 keeping the page order. In a simplex copying mode in which one side of each document is copied, the document passes between the rollers 91 and 92*a* and is ejected onto the tray 95 through the ejecting rollers 94 without using the diverter 93.

Next, a supporting mechanism of the conveying section 30 is described.

Figure 3B:
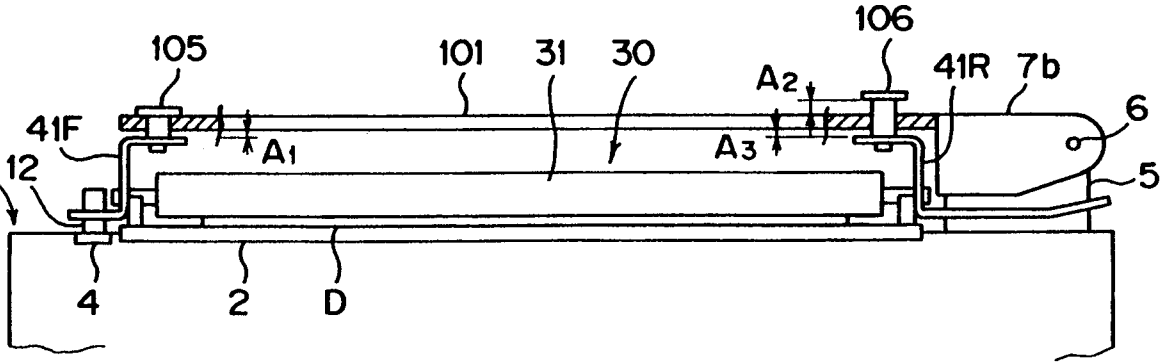

Referring to FIGS. 3*a* and 3*b*, two plates 101 are extended from movable fittings 7*b* of the hinges 5, and a front portion 41F and a rear portion 41R of a frame for holding the conveying section 30 are fastened to the plates 101 by shoulder bolts 105 and 106. Accordingly, the conveying section 30 are movable up and down within a clearance of $A_1$ or $A_2+A_3$.

Conventionally, ADFs have a problem in setting the conveying section on the platen glass. The level difference between the surface on which the hinges are fixed and the surface of the platen glass varies from machine to machine, and the surface on which the hinges are fixed and the surface of the platen glass may not be exactly parallel to each other. These cause the conveying section not to be correctly set on the platen glass. For example, the front side or the rear side of the conveying section does not come into contact with the platen glass. A conventional way of solving the problem is providing spacers on the surface of the machine body before fixing the hinges thereon. In connection with each machine, the level difference between the surface on which the hinges are fixed and the surface of the platen glass is adjusted in this way. In this embodiment, however, the conveying section 30 is fastened to the plates 101 by the shoulder bolts 105 and 106 so as to be movable up and down, that is, the conveying section 30 hangs from the plates 101. When the ADF 10 is pulled down onto the platen glass 2, the front and rear frame portions 41F and 41R, and the whole conveying section 30 move up or down within the clearance of $A_1$ or $A_2+A_3$, and the conveying section 30 is correctly set on the platen glass 2 automatically. Therefore it is no longer necessary to provide the spacers between the surface of the machine body and the hinges 5.

FIG. 3*b* shows a state where the ADF 10 is completely set on the platen glass 2. Preferably, in this state, the rear shoulder bolts 106 have clearances $A_2$ and $A_3$ both over and under the plates 101.

Figure 4:
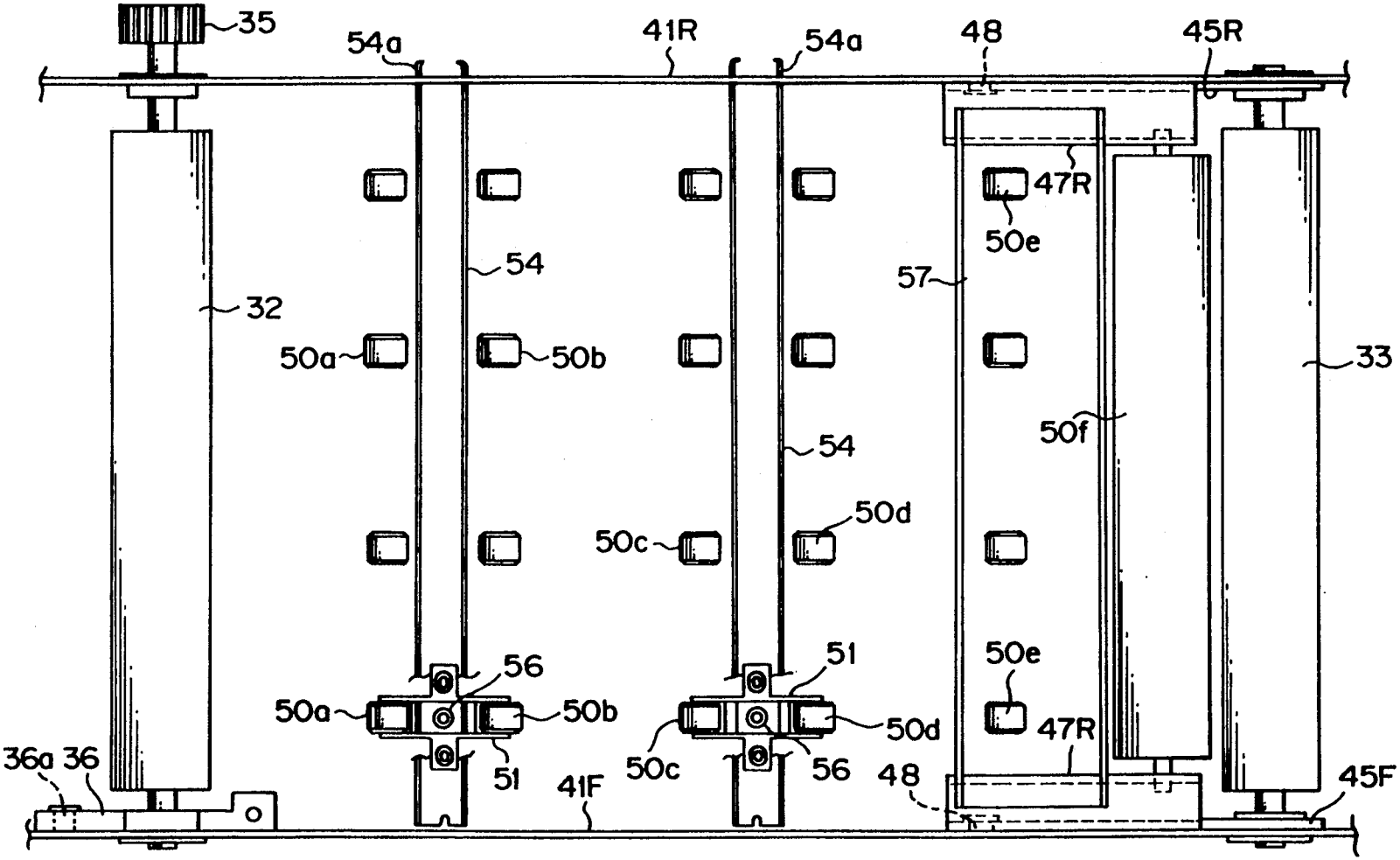
Figure 5:
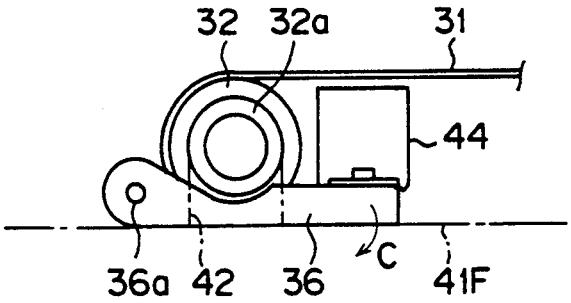

The conveyer belt 31 is an elastic endless belt. The belt 31 is laid between the driving roller 32 which transmits a force to the belt 31 and the driven roller 31 which applies a proper tension to the belt 31. As shown in FIG. 4, a gear 35 disposed outside of the rear frame portion 41R transmits a rotating force of a motor (not shown) to the driving shaft 32. As shown in FIG. 5, a front bearing 32*a* of the driving roller 32 is loosely fitted in a notch 42 formed on the front frame portion 41F, and a lever 36 prevents the bearing 32*a* from coming out of the notch 42. The lever 36 is capable of pivoting on a pin 36*a* and is screwed to a bracket 44 fixed on the front frame portion 41F.

Figure 6A:
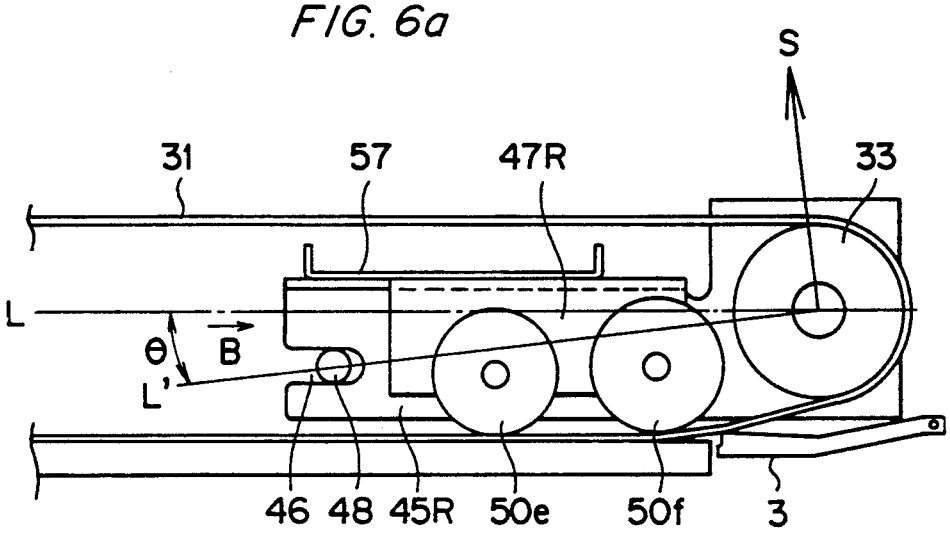
FIGS. 6*a* and 6*b* show fastening and unfastening of a driven roller to and from a frame.
Figure 6B:
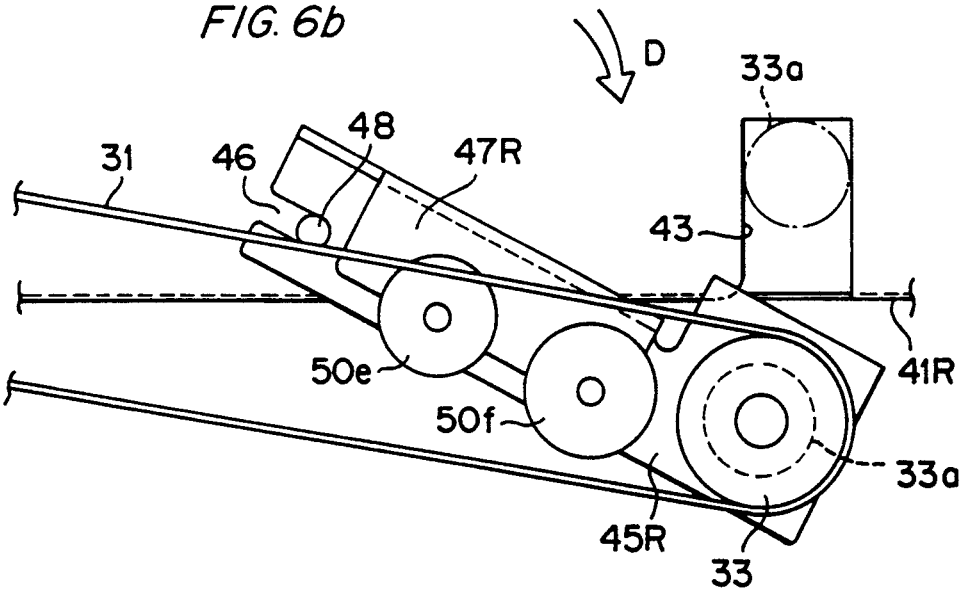
Figure 7:
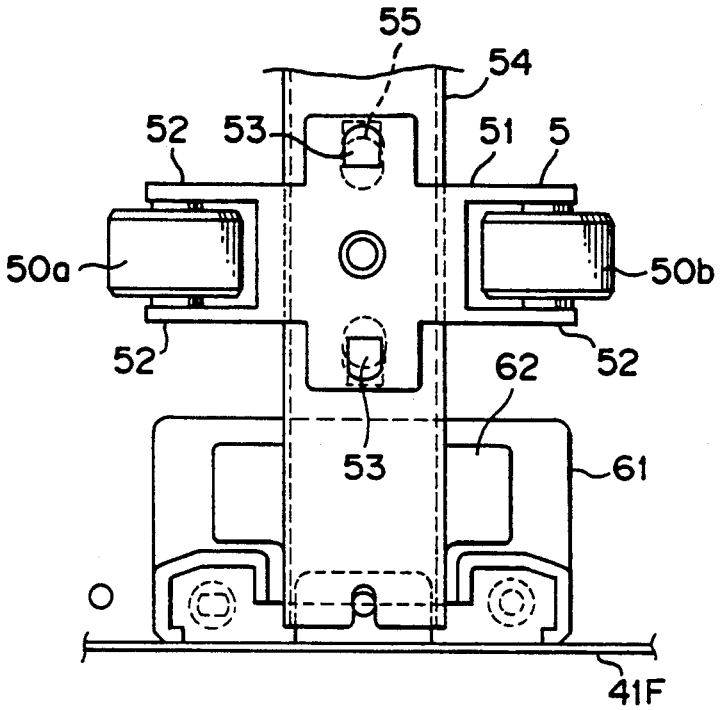
Figure 8:
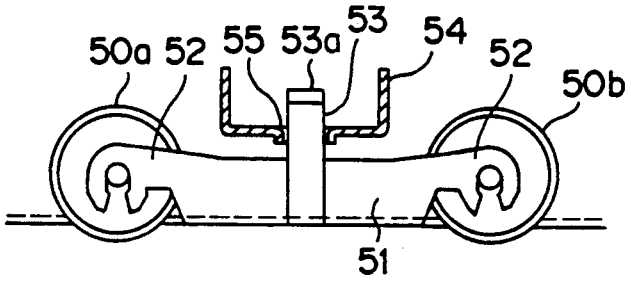
Figure 9:
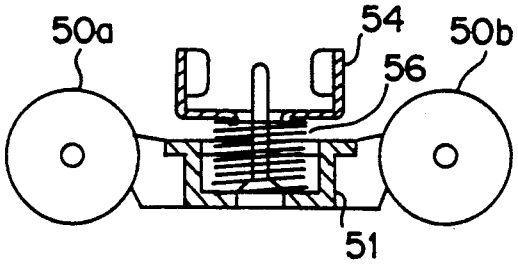
Figure 10:
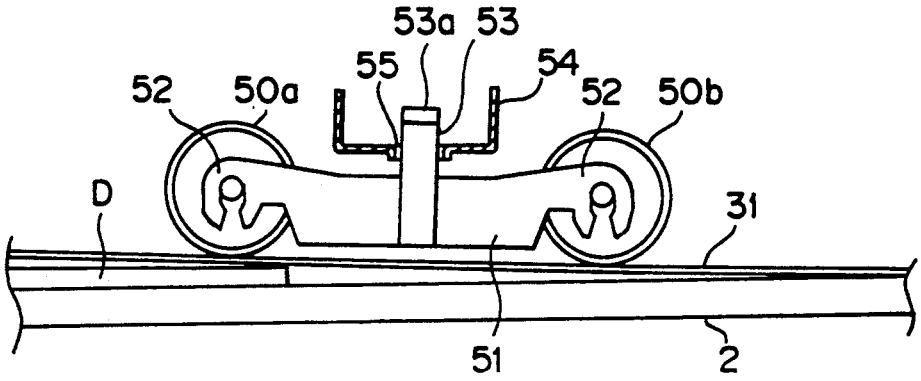
Figure 11:
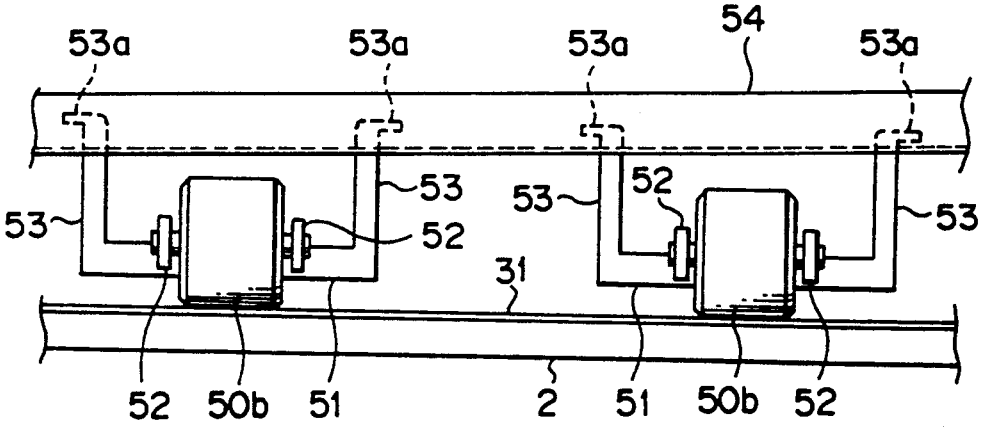
Figure 12:
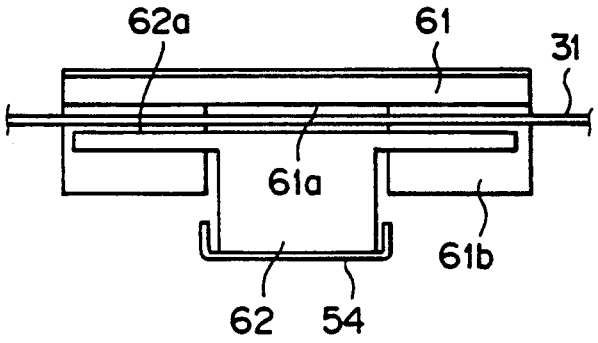
Figure 13:
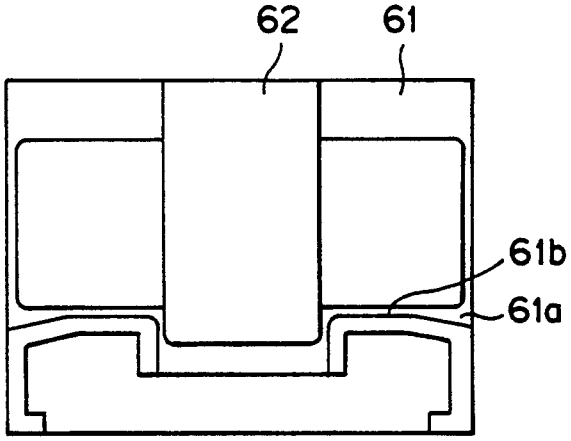
Figure 14A:
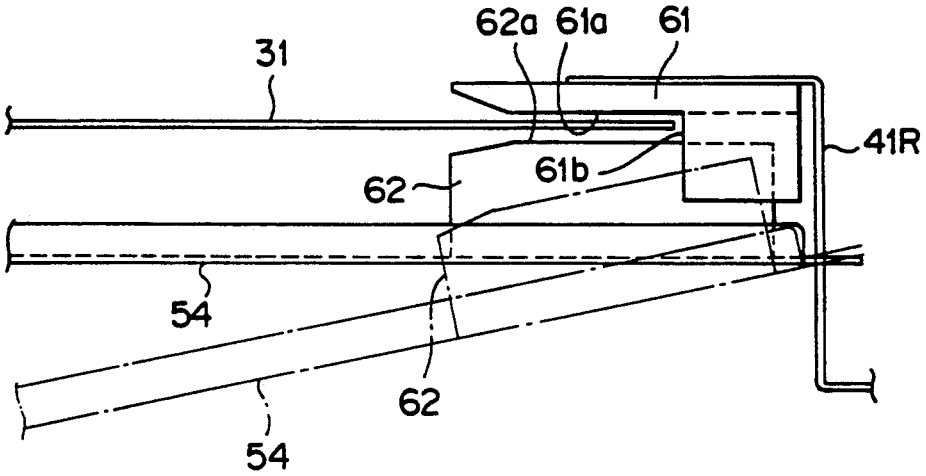
Figure 14B:
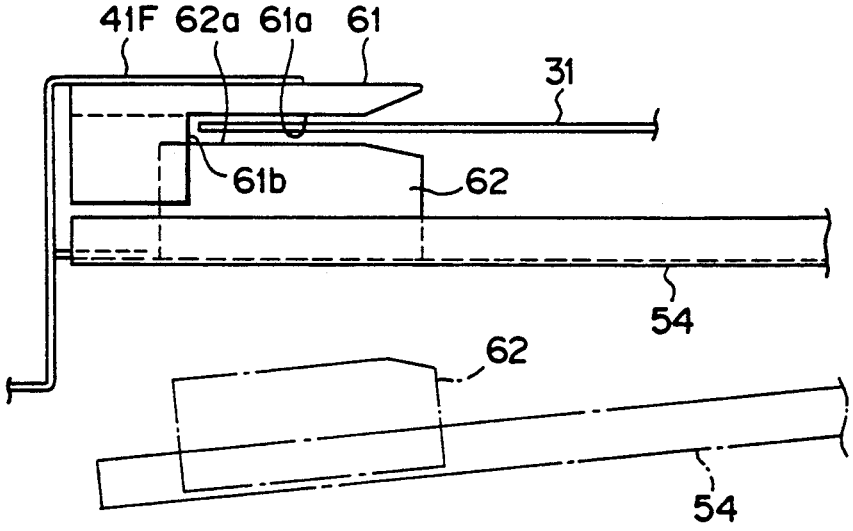

The driven roller 33, as shown in FIGS. 4, 6*a* and 6*b*, are rotatably held by tension plates 45F and 45R, and its shaft 33*a* is loosely fitted in notches 43 formed on the front and rear frame portions 41F and 41R. The tension plates 45F and 45R have notches 46, and the notches 46 engage with pins 48 standing on the frame portions 41F and 41R. Thereby, the tension plates 45F and 45R are capable of pivoting on the pins 48. As the ADF 10 is being lifted up from the platen glass 2, the tension plates 45F and 45R pivots on the pins 48 in a direction indicated with arrow D. Thereby, the tension of the conveyer belt 31 is lost. In this state, the conveyer belt 31 is removed from the ADF 10, and a new belt is set.

The pins 48 which are the pivots of the tension plates 45F and 45R are disposed under a line L drawn between the axis of the driving roller 32 and the axis of the driven roller 33. A line L' drawn between the axis of the driven roller 33 and the axis of each pin 48 is at an angle of $\theta$ to the line L. Thereby, while the conveying section 30 is set on the platen glass 2, as shown in FIG. 6*a*, the elasticity of the conveyer belt 31 applies a momentum to the tension plates 45F and 45R and the driven roller 33 in a direction indicated with arrow S, and accordingly, there is no fear that the driven roller 33 may come off downward because of its own weight.

If the conveyer belt 31 is made of an inelastic member, the tension plates 45F and 45R are provided with tension springs (not shown) whose forces work in a direction indicated with arrow B, and these tension springs provide the conveyer belt 31 with tension.

Inside of the ring of the conveyer belt 31, as shown in FIGS. 1 and 4, back-up rollers 50*a*, 50*b*, 50*c*, 50*d*, 50*e* and 50*f* are disposed. These rollers press the conveyer belt 31 against the platen glass 2 so as to ensure stable conveyance of documents. The rollers 50*a* through 50*e* are of a ring type, and the roller 50*f* is of a roll type. A document conveyed by the conveyer belt 31, when its leading edge hits the scale 3, comes to a stop and is set in a regular position. At that time, if the roller 50*f* is of a ring type, the leading portion may partly come up on the scale 3 because the ring type roller cannot press the leading portion entirely. In order to prevent this trouble, the back-up roller 50*f* which is the closest to the leading edge stop position is a single roll which is longer than the width of a document of the biggest size which can be handled by the ADF 10.

The back-up rollers 50*a* through 50*f* are so arranged that a document of the smallest size in respect to the conveying direction can be pressed by at least two lines of rollers via the conveyer belt 31 all the time during conveyance of the document. More specifically, supposing that the length of the smallest size document is $L_0$, that the interval between the rollers 50*a* and 50*c* is $L_1$, that the interval between the rollers 50*c* and 50*e* is $L_2$, that the interval between the rollers 50*b* and 50*d* is $L_3$ and that the interval between the rollers 50*d* and 50*f* is $L_4$, all the intervals $L_1$, $L_2$, $L_3$ and $L_4$ are smaller than the length $L_0$. In the structure, even the smallest size document can be pressed by at least two lines of rollers all the time, and the document can be conveyed on the platen glass 2 stably without a skew.

Each couple of back-up rollers 50*a* and 50*b*, and 50*c* and 50*d* is held by a holder 51 such that the rollers 50*a* through 50*d* rotate freely in the conveying direction (see FIGS. 7 through 11). Although the following describes a couple of rollers 50*a* and 50*b* held by a holder 51, the other couples of rollers 50*a* and 50*b* and all the couples of rollers 50*c* and 50*d* have the same structure.

The holder 51 has two arms 52 for holding the rollers 50*a* and 50*b* and two protrusions 53 which protrude upward. The protrusions 53 come into holes 55 of a rail 54, and claws 53*a* at the top of the protrusions 53 are caught by the edges of the holes 55. In this state, the holder 51 is hanging from the rail 54. The rail 54 has a concave cross section and is fastened to the front and the rear frame portions 41F and 41R to be laid therebetween. A spring 56 is provided between the rail 54 and the holder 51 so as to urge the rollers 50*a* and 50*b* toward the platen glass 2.

The protrusions 53 of the holder 51 are movable up and down, back and forth, and right and left within the holes 54. Accordingly, the rollers 50*a* and 50*b*, together with the holder 51, are movable up and down, are capable of slanting in a vertical plane parallel to the conveying direction (see FIG. 10) and are capable of slanting in a vertical plane perpendicular to the conveying direction (see FIG. 11). Thereby, the back-up rollers 50*a* and 50*b* can press the conveyer belt 31 evenly against the platen glass 2 even if the platen glass 2 is deformed or inclined, or if the ADF 10 is not correctly mounted on the machine body 1. Consequently, the conveyance of documents by the conveyer belt 31 can be remarkably improved.

The rear end 54*a* of the rail 54 is inserted into a notch (not shown) formed on the rear frame portion 41R (see FIG. 4), and the front end of the plate 54 is screwed to the front frame portion 41F. In a state that the ADF 10 is open (in a vertical posture), when the rail 54 is unfastened from the front frame portion 41F, the rail 54 is capable of pivoting to the front on the engaging point with the rear frame portion 41R.

As shown in FIGS. 4, 6*a* and 6*b*, side plates 47F and 47R are provided on the tension plates 45F and 45R respectively, and a supporting plate 57 is laid between the side plates 47F and 47R. The back-up roller 50*e* is rotatably supported by the supporting plate 57 via holders (not shown). The roll type back-up roller 50*f* is rotatably held between the side plates 47F and 47R. Not only the driven roller 33 and the tension plates 45F and 45R but also the back-up roller 50*e*, the supporting plate 57 and the back-up roller 50*f* pivot on the pins 48 altogether (see FIG. 6*b*). On the other hand, by putting a shaft 33*a* of the driven roller 33 into notches 43 formed on the front and rear frame portions 41F and 41R, the conveyer belt 31 is set to a regular position in the ADF 10.

Now an exchange of conveyer belts is described.

Because the conveyer belt 31 is whitish, the conveyer belt 31 is soiled easily, and the soil of the belt 31 degrades a copy image. For this reason, the conveyer belt 31 must be cleaned or exchanged with a new belt every specified period. When exchanging the conveyer belt 31, first the ADF 10 is lifted up to be in a vertical posture, and the tension plates 45F and 45R pivot to the front (in a direction indicated with arrow D in FIG. 6*b*) on the pins 48. This movement release the conveyer belt 31 from tension. Next, the lever 36 is unfastened from the front frame portion 41F and pivots on the pin 36*a* in a direction indicated with arrow C in FIG. 5. Thereby, the front end of the driving roller 32 becomes free, and the driving roller 32 slightly pivots to the front on the engaging point with the rear frame portion 41R. Then, the rails 54 of the back-up rollers 50*a*, 50*b*, 50*c* and 50*d* are unfastened from the front frame portion 41F and slightly pivots to the front on the rear frame portion 41R. The tension plates 45F and 45R holding the driven roller 33, and the back-up rollers 50*e* and 50*f* are unfastened from the front and rear frame portions 41F and 41R by disengaging the notches 46 of the plates 45F and 45R from the pins 48.

In this state, the conveyer belt 31 is pulled out of the driving roller 32 and the driven roller 33, and a new belt is fitted on. After the fitting-on of the new belt, the unfastened members are returned to the set positions in the reverse order.

Next, a device for preventing snaking of the conveyer belt 31 is described.

The conveyer belt 31 is endlessly laid between the driving roller 32 and the driven roller 33 which are disposed such that their axes run parallel with each other. Actually, however, the axes of the rollers 32 and 33 may not be exactly parallel, and the sides of the belt 31 are provided with different strengths of tension. Hence, the conveyer belt 31 is likely to snake. The snaking of the conveyer belt 31 causes a skew of a document. Also, the conveyer belt 31 may lean toward one side, thereby stopping the conveyance of documents. In order to prevent the snaking of the conveyer belt, conventionally, plates having grooves are disposed at both sides of the conveyer belt, and the sides of the conveyer belt are inserted in the respective grooves. In this structure, when the conveyer belt is exchanged with a new one, the operator is likely to forget to insert the sides of the newly fitted conveyer belt in the grooves.

In this embodiment, as shown in FIGS. 12, 13, 14*a* and 14*b*, snaking prevention boards 61 and snaking prevention boards 62 work in couples. The snaking prevention boards 62 are fixed on one of the holder rails 54 at their front and rear sides, and the snaking prevention boards 61 are fixed on the front and rear frame portions 41F and 41R such that each of the boards 61 faces to the corresponding board 62. The boards 61 each have a horizontal guide surface 61*a* and a vertical guide surface 61*b*. The boards 62 each have a horizontal guide surface 62*a*. Each of the horizontal guide surfaces 61*a* and 62*a* is declined at a side closer to the center of the belt 31.

While the holder rail 54 is fastened to the front and the rear frame portions 41F and 41R (the ADF 10 is operating), the horizontal guide surfaces 61*a* and 62*a* face to each other with a space slightly larger than the thickness of the conveyer belt 31 and guide the upper and the lower surfaces of the belt 31 from the front and the rear sides. Further, the vertical guide surfaces 61*b* guide side edges of the belt 31 and prevent the belt 31 from snaking. The horizontal guide surfaces 61*a* and 62*a* prevent the belt 31 from bending when the belt 31 comes into contact with one of the vertical guide surfaces 61*b*. When the rail 54 pivots for an exchange of the conveyer belt 31, the snaking prevention boards 62 separate from the snaking prevention boards 61 as indicated with dashed lines in FIGS. 14*a* and 14*b*. In this state, the conveyer belt 31 is exchanged. When a new conveyer belt 31 is wound around the rollers 32 and 33, the rear side of the belt 31 is inserted between the rear snaking prevention boards 61 and 62, and the front side of the belt 31 is along the horizontal surface 61*a* of the front snaking prevention board 61. Then, when the front end of the rail 54 is returned to the front frame portion 41F, the front and the rear sides of the belt 31 are caught between the snaking prevention boards 61 and 62. In this way, the snaking prevention device is automatically set without the operator's attention.

Figure 15:
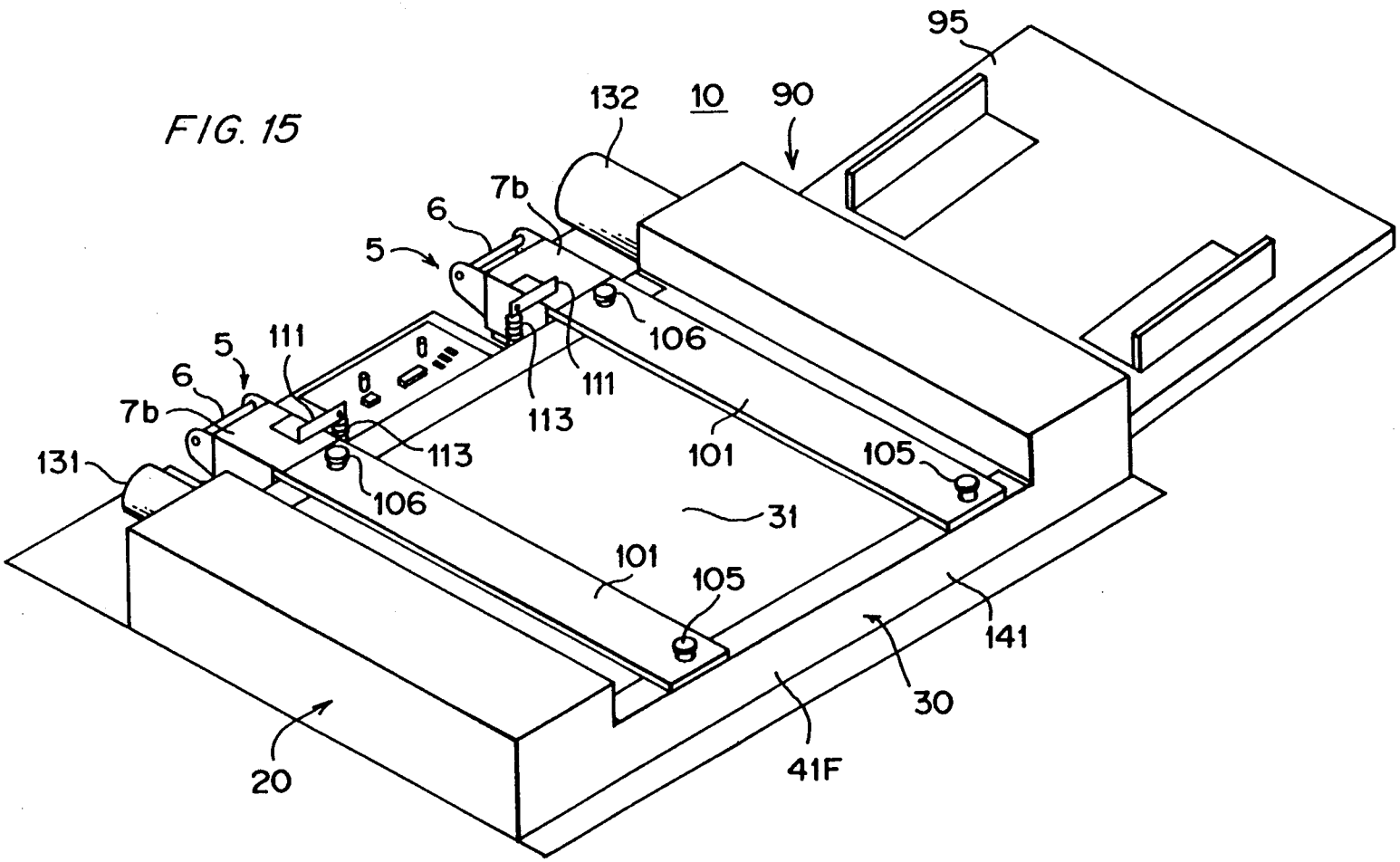
FIG. 15 shows an ADF which is a second embodiment of the present invention, and especially shows its hinge system.
Figure 16A:
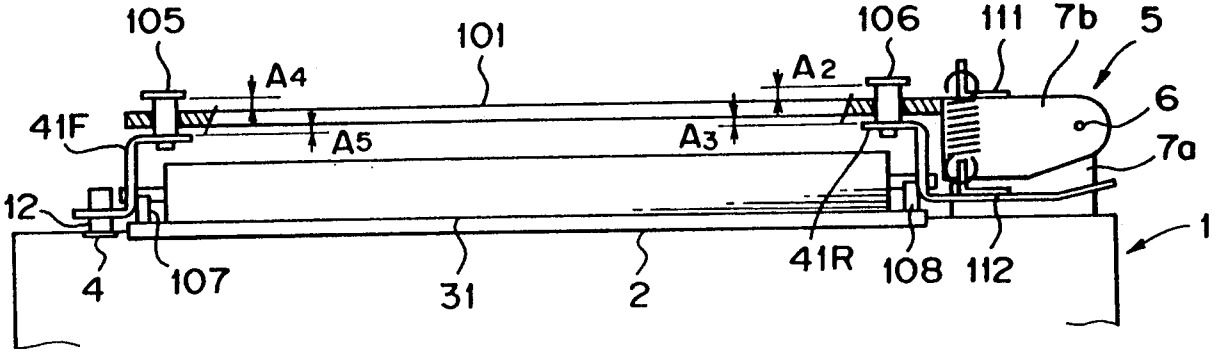
FIGS. 16*a* and 16*b* show the ADF in an open state and a closed state respectively.
Figure 16B:
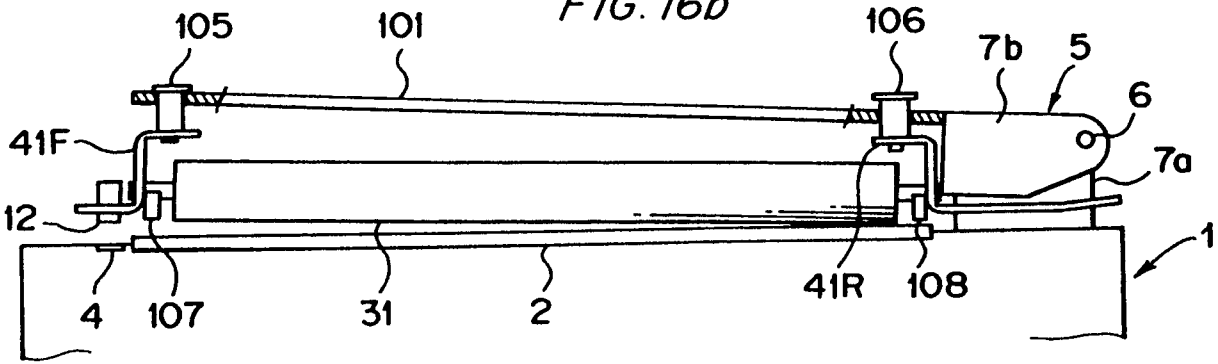

Second Embodiment: FIGS. 15, 16*a* and 16*b*

An ADF of a second embodiment has features in the structure for mounting thereof on a body of a copying machine and in the structure for support of the conveying section. The internal composition of the ADF is the same as that of the first embodiment. In the following description of the second embodiment, components used in the first embodiment are denoted by the same numbers and marks as in the first embodiment.

The feeding section 20, the conveying section 30 and the reversing/ejecting section 90 are housed in a frame 41. The frame 41 has a front portion 41F and a rear portion 41R. Two hinges 5 are provided such that their fixed fittings 7*a* are fixed on a body 1 of a copying machine at the back of the rear portion 41R of the frame 41 and that plates 101 are extended from their movable fittings 7*b* to the front frame portion 41F. The front and rear frame portions 41F and 41R are screwed to the plates 101 via shoulder bolts 105 and 106. The conveying section 30 is movable from and to the plates 101 within a clearance of $A_2+A_3$ or $A_4+A_5$. Spacers 107 and 108 are fixed on the back sides of the front and rear frame portions 41F and 41R, and the spacers 107 and 108 come into contact with the platen glass 2 when the ADF 10 is closed.

While the ADF 10 is open, the conveying section 30 is hanging from the shafts 101 by its own weight. When the ADF 10 is completely closed, the magnets 12 stick to the magnetic plates 4 as shown in FIG. 16*a*. In this state, the spacers 107 and 108 stand on the platen glass 2, and thereby, the conveyer belt 31 is laid such that its surface is parallel to the platen glass 2 with a certain space.

In the structure wherein the conveyer section 30 is hanging from the plates 101, even if the hinges 5 have errors in production of the parts or errors in the assembly, or even if the platen glass 2 is slightly inclined, the frame 41 is movable up and down within the clearance of $A_2+A_3$ or $A_4+A_5$ generated by using the shoulder bolts 105 and 106, and the conveying section 30 automatically fits to the surface of the platen glass 2. Accordingly, it is no longer necessary to adjust the level of the hinges 5 to the level of the platen glass 2 by using spacers when the machine is set up.

However, in the hanging structure, the ADF 10 is unstably set. In the ADF 10, heavy components such as a belt motor 131, a feed motor (not shown) and an ejection motor 132 are provided in the rear side, and the ADF 10 is mass-imbalanced. Accordingly, when the ADF 10 is closed, a momentum to turn the front side upward on the rear spacers 108 acts on the ADF 10. In this state, with a shock or a vibration (especially clamshell type shock or vibration) at a time of opening or closing the machine body 1, the magnets 12 separate from the magnetic plates 4, and the front side of the ADF 10 is slightly lifted up (see FIG. 16*b*). In the second embodiment, the rear side of the ADF 10 is pulled upward elastically so as to lighten the load on the rear side. Specifically, tabs 111 are fixed on the movable fittings 7*b* of the hinges 5, and tabs 112 are fixed on the rear frame portions 41R right under the tabs 111. Compression springs 113 are provided between the tabs 111 and 112. The springs 113 urge the rear side of the ADF 10 upward elastically, and the ADF 10 becomes mass-balanced. In this way, the trouble that the front side of the ADF 10 is lifted up with a shock or a vibration can be prevented.

The force of the springs 113 must be large enough to mass balance the ADF 10 but not too large to lift up the rear side spacers 108 with the passage of a document therethrough. The two plates 101 have loads with different mass-balance (the left rear side is relatively heavy), and it is preferred that the springs 113 have different strengths accordingly. Further, preferably, the forces of the springs 113 are adjusted such that the spacers 107 and 108 disposed at the four corners of the conveying section 30 can be in contact with the platen glass 2 with the same pressure. If the conveying section 30 is set on the platen glass 2 with mass-balance in this way, the conveyer belt 31 will be in contact with the platen glass 2 entirely with an even pressure and achieve good conveyance of documents.

Figure 17:
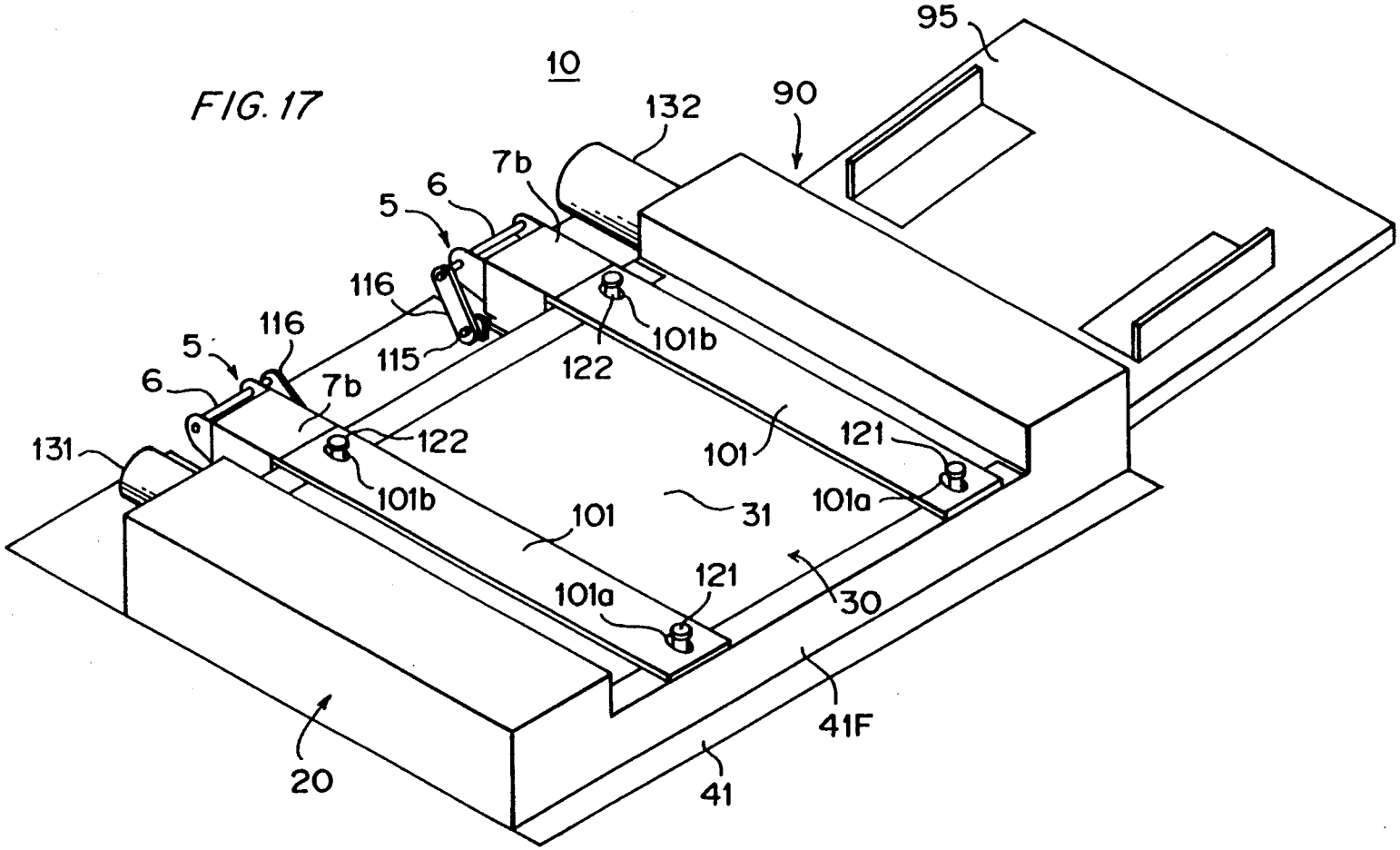
FIG. 17 shows an ADF which is a third embodiment of the present invention, and especially shows its hinge system.
Figure 18A:
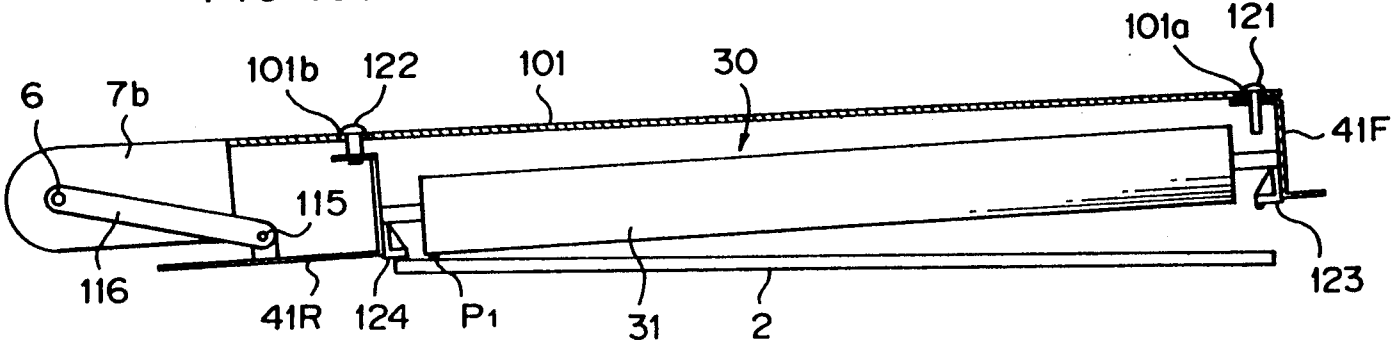
FIGS. 18*a* and 18*b* show the ADF in an open state and a closed state respectively.
Figure 18B:
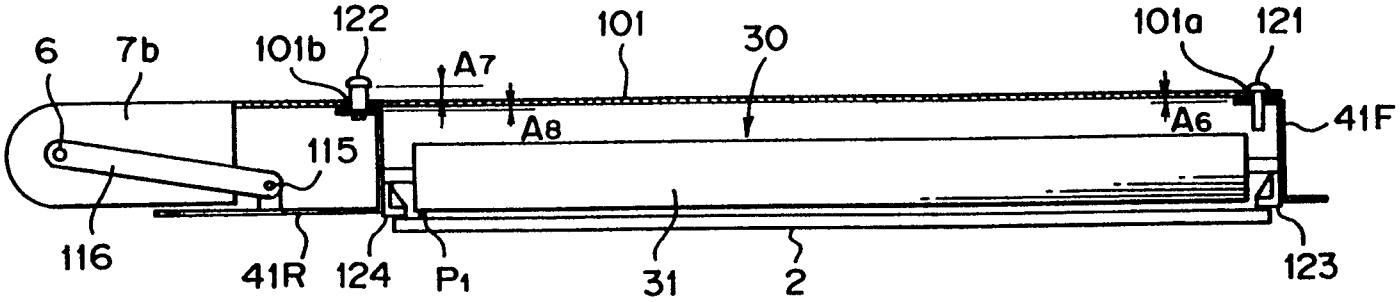

Third Embodiment: FIGS. 17, 18*a* and 18*b*

When an ADF is closed after manual setting of a document on a platen glass, it is likely that the document is drawn by the ADF and displaced. An ADF of a third embodiment has a structure to solve this problem. The ADF has features in the structure for mounting thereof on a body of a copying machine and in the structure for support of the conveying section. The internal composition of the ADF is the same as that of the first embodiment. In the following description of the third embodiment, components used in the first embodiment are denoted by the same numbers and marks as in the first embodiment.

The feeding section 20, the conveying section 30 and the reversing/ejecting section 90 are housed in a frame 41. The frame 41 has a front portion 41F and a rear portion 41R. The front and rear portions 41F and 41R of the frame 41 are screwed to the plates 101 via shoulder bolts 121 and 122. The conveying section 30 is movable from and to the plates 101 within a clearance of $A_6$ or $A_7+A_8$. Spacers 123 and 124 are fixed on the back sides of the front and rear frame portions 41F and 41R, and the spacers 123 and 124 come into contact with the platen glass 2 when the ADF 10 is closed.

While the ADF 10 is open, the conveying section 30 is hanging from the plates 101 by its own weight. When the ADF 10 is completely closed, the magnets 12 stick to the magnetic plates 4 as shown in FIG. 18*b*. In this state, the spacers 123 and 124 stand on the platen glass 2, and thereby, the conveyer belt 31 is laid such that its surface is parallel to the platen glass 2 with a certain space.

The shoulder bolts 121 and 122 are inserted in holes 101*a* and 101*b* made in the shafts 101. The holes 101*a* and 101*b* are long holes extending to the front and rear. Thereby, the frame 41 is capable of sliding back and forth within a clearance of the long holes 101*a* and 101*b*. Pins 115 are fixed in the rear frame portion 41R so as to be extended toward the hinges 5, and levers 116 are disposed between the pivots 6 of the hinges 5 and the pins 115.

When the ADF 10 is pushed down to the platen glass 2, as shown in FIG. 18*a*, the rear edge of the conveyer belt 31 first comes into contact with the platen glass 2 ($P_1$ denotes the contact point). In a conventional ADF, as the ADF is further being pushed down, the conveyer belt moves to the rear. In the third embodiment, however, the connection of the rear frame portion 41R with the hinge pivots 6 by the levers 116 prevents the conveyer belt 31 from moving to the rear, that is, the contact point of the rear edge of the conveyer belt 31 with the platen glass 2 stays at the point $P_1$ until the ADF 10 is completely closed (see FIG. 18*b*). This is because the shoulder bolts 121 and 122 are inserted in the long holes 101*a* and 101*b* made in the plates 101 with the clearance. More specifically, movement of the shoulder bolts 121 and 122 to the front within the long holes 101*a* and 101*b* releases tension applied to the point $P_1$. In this structure, even if a document is set on the platen glass 2, there is no fear that the rear edge of the conveyer belt 31 may draw the document to the rear.

Preferably, each of the pins 115 supporting the levers 116 are extended along or near a line drawn between the corresponding hinge pivot 6 and the point $P_1$.

Moreover, the ADF of the third embodiment has the same advantages of the second embodiment. The conveying section 30 is hanging from the plates 101. Thereby, even if the hinges 5 have errors in production of the parts and in the assembly, or even if the platen glass 2 is inclined, since the frame 41 is movable up and down within the clearance of $A_6$ or $A_7+A_8$, the conveying section 30 is automatically set on the platen glass 2 correctly. Also, the hinges 5 are provided with spring members (not shown), and the spring members urge the rear side of the ADF upward so that the conveying section 30 can be mass-balanced. Practically, in the middle of an opening or closing action of the ADF 10, the ADF 10 comes to a stop at a position where the weight of the ADF 10 is balanced with the force of the spring members. When the spacers 124 come into contact with the platen glass 2 before the ADF 10 is completely closed, the weight of the ADF 10 is partly supported by the platen glass 2, thereby losing the balance of the ADF 10 with the force of the spring members. Accordingly, the ADF 10 may come to a stop before the ADF 10 is completely closed. Additionally, even in this state, switches may detect by mistake that the ADF 10 is correctly set on the platen glass 2. The magnet 12 incorporating the lead switch and the magnetic plate 4 (see FIG. 3) prevent the error. The lead switch does not act until the magnet 12 sticks to the magnetic plate 4, which means the ADF 10 is completely closed.

Figure 19A:
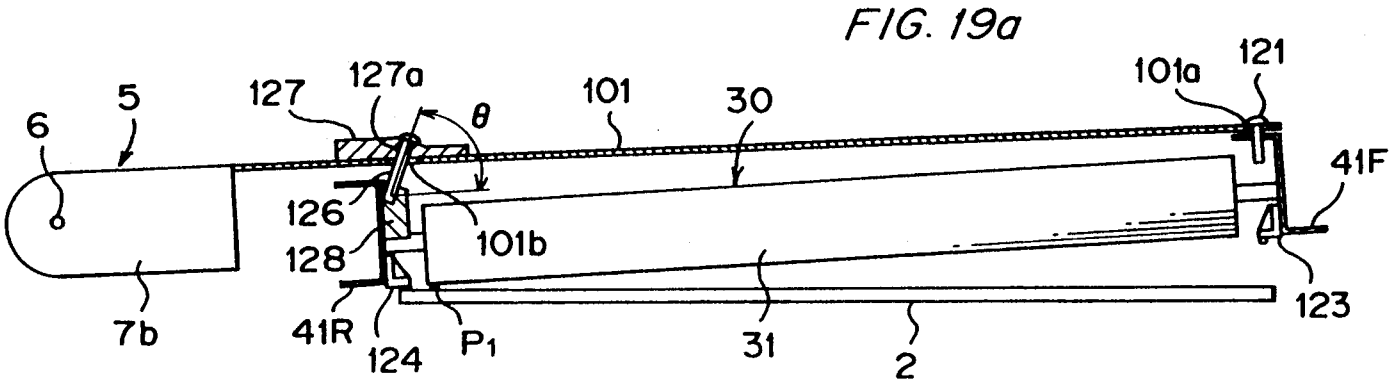
FIGS. 19*a* and 19*b* show an ADF which is a fourth embodiment of the present invention, and especially show the ADF in an open state and a closed state respectively.
Figure 19B:
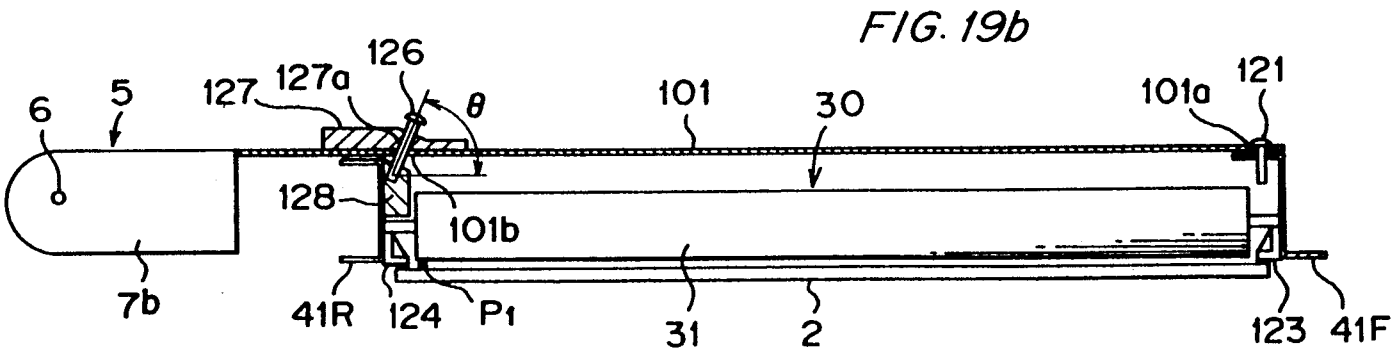

Fourth Embodiment: FIGS. 19*a* and 19*b*

An ADF of a fourth embodiment adopts another structure to prevent the conveyer belt 31 from moving to the rear with a closing action of the ADF. In the third embodiment, a link mechanism is adopted, while in the fourth embodiment, shoulder bolts 126 are used.

Brackets 128 are fixed on the rear portion 41R of the frame 41 under the plates 101, and guide blocks 127 are fixed on the upper surface of the plates 101. The shoulder bolts 126 are mounted in the brackets 128 at an angle of $\theta$ to the surface of the platen glass 2. The shoulder bolts 126 are also inserted in holes 127*a* of the guide blocks 127 so as to be slidable in the holes 127*a*. The holes 127*a* guide the shoulder bolts 126 so that the angle $\theta$ will never change. During a closing action of the ADF 10, after the conveying section 30 comes into contact with the platen glass 2, the shoulder bolts 126 slightly move upward guided by the holes 127*b*. Thereby, the angle $\theta$ is kept, and the frame 41 slightly moves to the front in relative to the plates 101. The forward motion of the frame 41 offsets the backward motion of the contact point Px of the rear edge of the conveyer belt 31 with the platen glass 2. As a result, the contact point stays at the point $P_1$ until the ADF 10 is completely closed.

Further, the ADF of the fourth embodiment are the same as the third embodiment in other points. In FIGS. 19*a* and 19*b*, components used in the third embodiment are denoted by the same numbers and marks as in the third embodiment.

Other Embodiments

Although the present invention has been described in connection with the preferred embodiments above, it is to be noted that various changes and modifications will be possible to those who are skilled in the art. Such changes and modifications are to be understood as being within the scope of the present invention.

The basic structure of the ADF is arbitrary. For example, the ADF can be so made that only the conveying section, not with the feeding section, is openable from the body of a copying machine.

Concerning the back-up rollers, the holding system can be so made that a single holder holds a single roller. The following structure is also possible. Rollers with center holes are loosely fitted around a shaft which has a smaller diameter than the holes of the rollers by piercing the shaft in the holes of the rollers, and the shaft is laid between the front and rear portions of the frame. Thereby, the back-up rollers press the conveyer belt against the platen glass by their own weight.

The pivot of the opening and closing actions of the ADF is not limited to the rear side, and the ADF can be so made that it pivots on the right side or the left side. The spring members for urging the ADF upward should be positioned in accordance with the position of motors or other heavy components.

The ADF can be attached to an analog type or digital type electrophotographic copying machine, an image reading apparatus or the like. The ADF may adopt any way of conveying documents. For example, the ADF may be a type of conveying documents one by one, a type of conveying documents to set two documents on the platen glass at a time, or a type of conveying a document without stopping the document on the platen glass and exposing the document during the conveyance.

What is claimed is:

1. An automatic document feeder for feeding a document onto a platen glass of an image forming apparatus and discharging the document therefrom, the automatic document feeder comprising:

a body frame mounted on the image forming apparatus, the body frame being capable of opening and closing the platen glass;

a driving roller of which shaft has one end which is fastened to the body frame detachably therefrom;

a driven roller of which shaft has one end which is fastened to the body frame detachably therefrom, the driven roller being in parallel to the driving roller at a specified space;

a conveyor belt which is an endless belt laid between the driving roller and the driven roller, the conveyor belt rotating with rotation of the driving roller and conveying a document on the platen glass;

a plurality of back-up rollers for pressing the conveyor belt against the platen glass;

a supporting member for supporting the back-up rollers and connecting the back-up rollers with the body frame, the supporting member having an end which is fastened to the body frame detachably therefrom; and snaking prevention means including a first member provided on the body frame and a second member provided on the supporting member for preventing said conveyor belt from snaking, said first member and said second member guiding the conveyor belt.

2. An automatic document feeder as claimed in claim 1, wherein the body frame is turned around a pivot extending in a document conveying direction to open and close the platen glass, and the detachable ends of the driving roller, the driven roller and the supporting member are away from the pivot.

3. An automatic document feeder as claimed in claim 2, wherein the body frame is turned around a pivot disposed at a rear side of the image forming apparatus to open and close the platen glass, and the detachable ends of the driving roller, the driven roller and the supporting member are at a front side of the image forming apparatus.

4. An automatic document feeder as claimed in claim 3, wherein when the body frame pivots to a substantially vertical posture, the detachable ends of the driving roller, the driven roller and the supporting member come off the body frame toward the front side of the image forming apparatus.

5. An automatic document feeder as claimed in claim 1, wherein said first member and said second member face each other with a space slightly larger than a thickness of the conveyor belt and cover at least one edge of the conveyor belt.

6. An automatic document feeder as claimed in claim 5, wherein said first member has a vertical guide surface to guide the edge of the conveyer belt.

7. An automatic document feeder for feeding a document onto a platen glass of an image forming apparatus and discharging the document therefrom, the automatic document feeder comprising:

a first roller;

a second roller which is in parallel to the first roller at a specified space;

a conveyer belt for conveying a document, the conveyer belt being an endless belt laid between the first roller and the second roller;

a main frame for holding the first roller;

a sub frame for holding the second roller, the sub frame being pivoted on the main frame, the pivot being out of a line drawn between an axis of the first roller and an axis of the second roller; and a stopper for preventing the sub frame from pivoting toward the opposite side of the line drawn between the axis of the first roller and the axis of the second roller to the side of the pivot of the sub frame.

8. An automatic document feeder as claimed in claim 7, wherein the pivot of the sub frame is closer to the platen glass than the line drawn between the axis of the first roller and the axis of the second roller.

9. An automatic document feeder as claimed in claim 7, wherein the main frame is mounted on the image forming apparatus such that the main frame is capable of opening and closing the platen glass, and the main frame is turned around a pivot extending in a document conveying direction to open and close the platen glass.

10. An automatic document feeder as claimed in claim 9, wherein the pivot of the sub frame is closer to the platen glass than the line drawn between the axis of the first roller and the axis of the second roller.

11. An automatic document feeder for feeding a document into a platen glass of an image forming apparatus and discharging the document therefrom, the automatic document feeder comprising:

a main frame;

a subframe rotatably provided on said main frame;

a first roller provided on said main frame;

a second roller provided on said subframe in parallel to the first roller;

a conveyer belt laid between the first roller and the second roller; and a stopper which holds the subframe on the main frame at a predetermined relation in which the distance between the first roller and the second roller becomes a predetermined distance.

12. An automatic document feeder as claimed in claim 11, wherein said main frame is pivotally mounted on the image forming apparatus, whereby the main frame is capable of opening and closing the platen glass.

* * * * *